US007121838B2

(12) United States Patent
DeFord et al.

(10) Patent No.: US 7,121,838 B2
(45) Date of Patent: Oct. 17, 2006

(54) ELECTRONIC ASSEMBLY HAVING ANGLED SPRING PORTIONS

(75) Inventors: Brian L. DeFord, Chandler, AZ (US); Donald T. Tran, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 369 days.

(21) Appl. No.: 10/410,733

(22) Filed: Apr. 9, 2003

(65) Prior Publication Data

US 2004/0203261 A1 Oct. 14, 2004

(51) Int. Cl.
*H01R 12/00* (2006.01)

(52) U.S. Cl. ..... 439/66

(58) Field of Classification Search ..... 439/66, 439/862, 83, 91, 591, 71, 59–65, 74
See application file for complete search history.

(56) References Cited

U.S. PATENT DOCUMENTS

| | | | | |
|---|---|---|---|---|
| 4,927,369 | A | 5/1990 | Grabbe et al. | |
| 5,772,451 | A | 6/1998 | Dozier, II et al. | |
| 6,132,220 | A | 10/2000 | McHugh et al. | |
| 6,315,576 | B1 | 11/2001 | Neidich | |
| 6,330,164 | B1 | 12/2001 | Khandros et al. | |
| 6,528,984 | B1 * | 3/2003 | Beaman et al. | 324/158.1 |
| 6,561,819 | B1 * | 5/2003 | Huang et al. | 439/66 |
| 6,585,527 | B1 * | 7/2003 | Koopman et al. | 439/71 |
| 6,733,303 | B1 * | 5/2004 | Maldonado et al. | 439/66 |
| 2004/0072456 | A1 * | 4/2004 | Dozier et al. | 439/83 |
| 2004/0077190 | A1 * | 4/2004 | Huang et al. | 439/66 |
| 2004/0077202 | A1 | 4/2004 | Copper et al. | |

FOREIGN PATENT DOCUMENTS

| | | |
|---|---|---|
| EP | 1 087 467 A2 | 3/2001 |
| WO | WO 2004049507 A2 | 6/2004 |

OTHER PUBLICATIONS

PCT International Search Report, International Application No. PCT/US2004/006879; International Filing Date, May 3, 2004; mailing date, Mar. 18, 2005 (9 pp.).

* cited by examiner

*Primary Examiner*—J. F. Duverne
(74) *Attorney, Agent, or Firm*—Blakely, Sokoloff, Taylor & Zafman LLP

(57) ABSTRACT

An electronic assembly is provided, having a plurality of spring elements interconnecting corresponding terminals of first and second arrays of terminals on first and second electronic devices. The arrays have rows and columns extending in x- and y-directions, respectively. Each spring element has a cantilever portion extending diagonally in the x- and y-directions between corresponding terminals of the first and second arrays.

17 Claims, 3 Drawing Sheets

ELECTRONIC ASSEMBLY HAVING ANGLED SPRING PORTIONS

BACKGROUND OF THE INVENTION

1). Field of the Invention

This invention relates to an electronic assembly of the kind that may have a socket with spring contacts for making contact with terminals on a semiconductor package substrate.

2). Discussion of Related Art

Integrated circuits are usually manufactured in and on wafers that are subsequently singulated into individual dies. A die may then be mounted to a package substrate for purposes of providing rigidity to the entire package and for purposes of routing of signals to a side of the package of the substrate opposing the die.

A socket may be mounted to a circuit board, which may be shaped and dimensioned to receive the semiconductor package. The package substrate and the socket typically have matching substrate and socket contact terminals through which signals can be provided between the package substrate and the socket.

The socket may have a plurality of socket springs. The substrate contact terminals may come into contact with free ends of the socket springs and then bend cantilever portions of the springs by movement of the substrate contact terminals toward a body of the socket. Forces created by the springs ensure good contact between the free ends of the springs and the socket contact terminals.

Such cantilever portions are usually aligned with rows or columns of an array of contact terminals to which they are attached. By aligning the cantilever portions in such a manner, the number of contact terminals in a particular row or column is limited by the lengths of the cantilever portions. The cantilever portions of the springs thus limit the number of electric signals that can be routed over a given surface area.

BRIEF DESCRIPTION OF THE DRAWINGS

The invention is described by way of example with reference to the accompanying drawings, wherein.

DETAILED DESCRIPTION OF THE INVENTION

Figure 1:
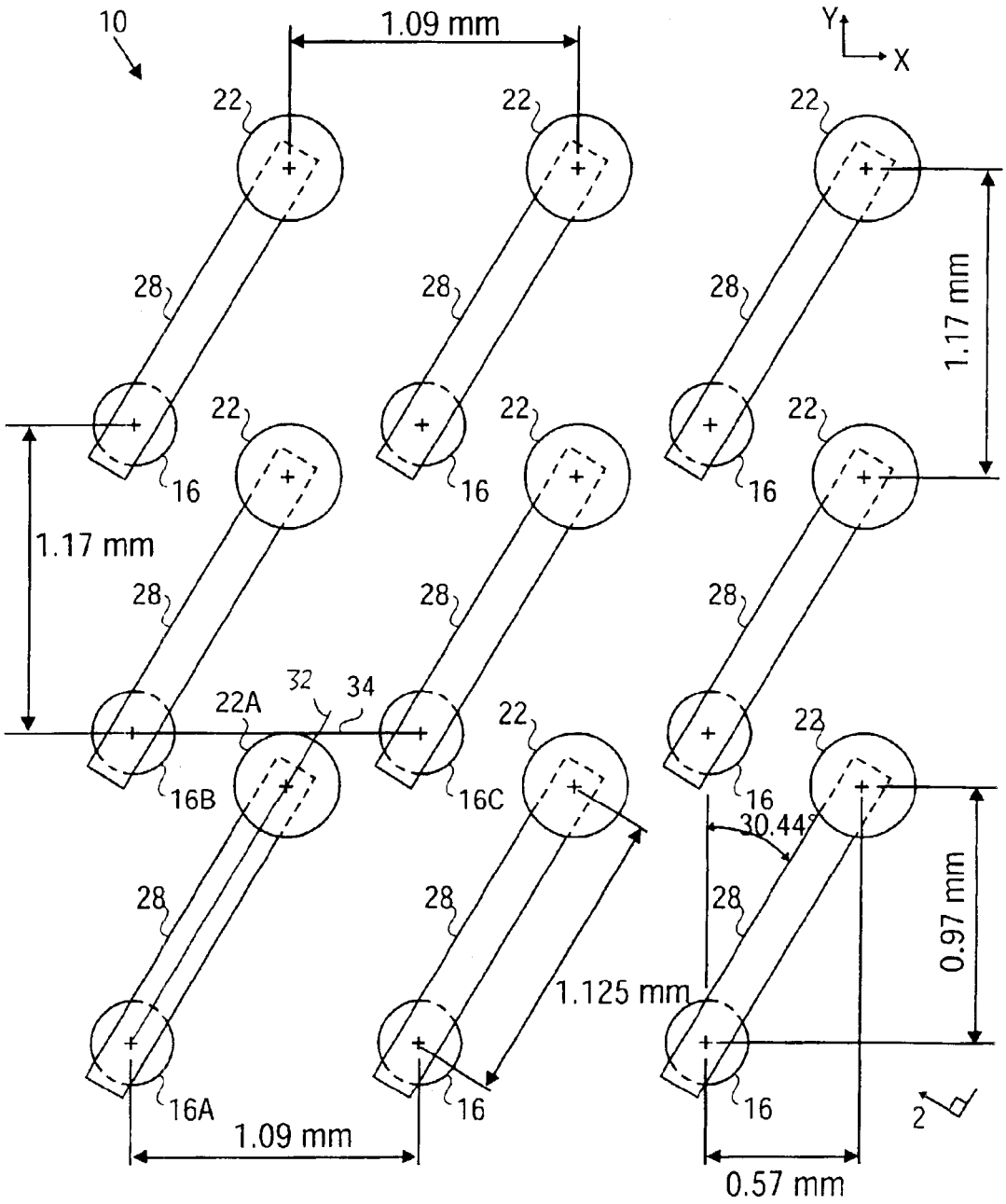
FIG. 1 is a top plan view of portions of an electronic assembly including socket solder balls, socket springs, and substrate contact terminals.
Figure 2:
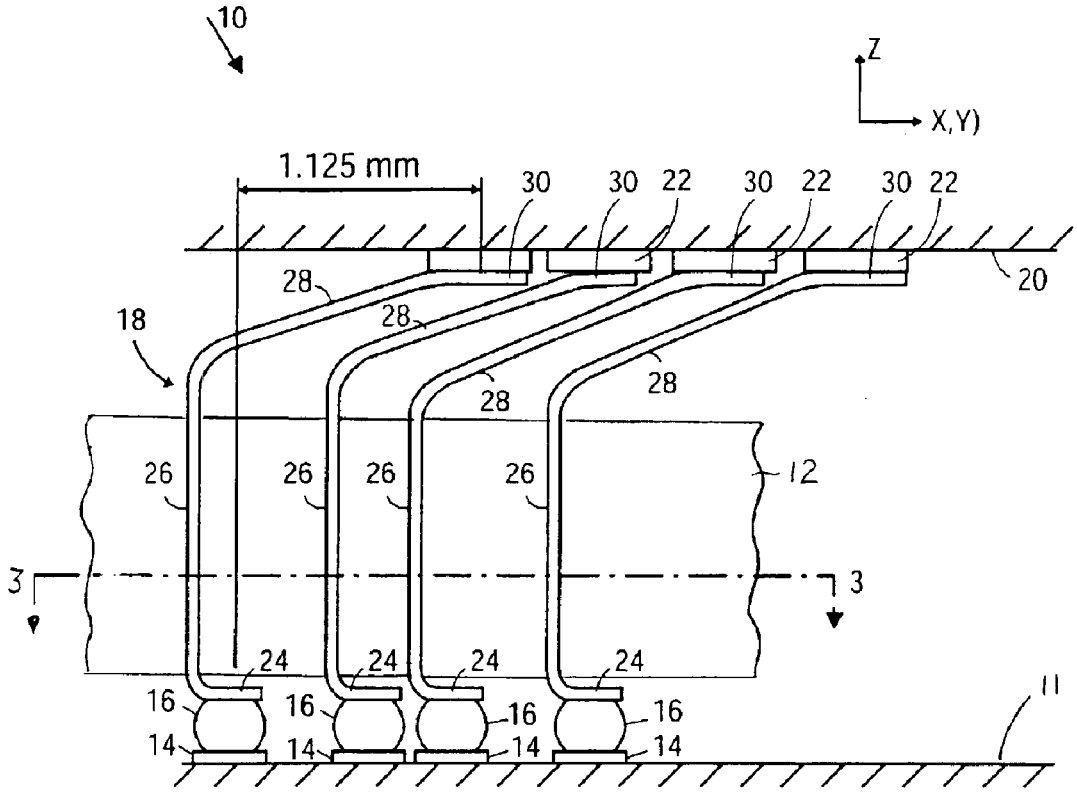
FIG. 2 is a side view in a direction 2 in FIG. 1 further illustrating additional components of the electronic assembly.

FIGS. 1 and 2 of the accompanying drawings illustrate components of an electronic assembly 10, according to an embodiment of the invention, including a printed circuit board 11, a socket body 12, printed circuit board contact terminals 14, socket solder balls 16, socket springs 18, a package substrate 20, and substrate contact terminals 22.

Referring specifically to FIG. 2, the socket springs 18 are all held within the socket body 12. A base portion 24 of each socket spring 18 has a respective socket solder ball 16 secured thereto. Each socket solder ball 16 is attached to a respective one of the printed circuit board contact terminals 14.

Each socket spring 18 has a respective spacer portion 26 extending in a z-direction from the base portion 24 thereof, and a respective cantilever portion 28 extending diagonally at an angle relative to the z-direction from an upper end of the respective spacer portion 26 thereof. The spacer portions 26 are held within openings in the socket body 12, and the cantilever portions 28 are above the socket body 12. A free end 30 of a respective cantilever portion 28 can be moved in a z-direction against a bending spring force of the cantilever portion 28.

The substrate contact terminals 22 are located on a lower surface of the package substrate 20. Each substrate contact terminal 22 is brought into contact with a respective free end 30 of a respective socket spring 18. The package substrate 20 is subsequently moved closer to the socket body 12. Movement of the package substrate 20 toward the socket body 12 bends the cantilever portions 28, which creates a spring force between a respective free end 30 and a respective substrate contact terminal 22. The spring force ensures good contact between the respective free end 30 and the respective substrate contact terminal 22.

As illustrated in FIG. 1, center points of the socket solder balls 16, cantilever portions 28, and center points of the substrate contact terminals 22 are dimensioned, spaced, and oriented in a manner that allows for a denser routing of signals over a given surface while still allowing sufficient flexibility of the cantilever portions 28.

Center points of the socket solder balls 16 are in an array having rows extending in an x-direction and columns extending in a y-direction. The columns in which the socket solder balls 16 are located are spaced from one another by a distance of 1.09 mm. The rows in which the socket solder balls 16 are located are spaced from one another by a larger distance of 1.17 mm. The larger pitch in the y-direction is due to design constraints for routing traces on a printed circuit board 11 to which the socket body 12 is mounted.

Center points of the substrate contact terminals 22 are also in an array of rows extending in an x-direction and columns extending in a y-direction. The columns in which the substrate contact terminals 22 are located are spaced from one another by a distance of 1.09 mm. The rows in which the substrate contact terminals 22 are located are spaced from one another by a distance of 1.17 mm. The spacing of the rows and columns of center points of the substrate contact terminals 22 is thus exactly the same as the spacing between the rows and columns of center points of the socket solder balls 16. The array formed by center points of the substrate contact terminals 22 is, however, offset relative to the array formed by center points of the socket solder balls 16 by a distance of 0.57 mm in the x-direction and 0.97 mm in the y-direction.

The cantilever portions 28 are oriented at an angle of 30.44°, measured clockwise relative to the y-direction. The ideal angle can be represented by the formula:

$$A = \mathrm{TAN}^{-1}(\text{pitch in } x\text{-direction}/(\text{pitch in } y\text{-direction}\times 2))$$
$$= \mathrm{TAN}^{-1}(1.09/(0.97\times 2))$$
$$= 29.33^\circ$$

The difference between the actual angle of 30.44° and the ideal angle of 29.33° is due to manufacturing constraints. The actual angle is preferably not more than 5° more or less from the ideal angle.

A line 32 can be drawn from a center point of the socket solder ball 16A to a center point of the substrate contact terminal 22A. A line 34 can be drawn from a center point of a socket solder ball 16B, in the same column but in an adjacent row to the socket solder ball 16A, to a center point of a socket solder ball 16C in the same row but in a column adjacent the socket solder ball 16B. An extension of the line 32 crosses through the line 34 and would cross through its center point if the angle were 29.33°.

By orienting all the cantilever portions 28 at the stated angle relative to the y-direction, the cantilever portions 28 can be made relatively long while still positioning a relatively large number of the solder balls 16 over a given area. In the given example, the center point of the socket solder ball 16A is spaced from a center point of the substrate contact terminal 22A by a distance of 1.125 mm, although the rows are spaced from one another by only 1.17 mm, and the columns are spaced from one another by only 1.09 mm.

Figure 3:
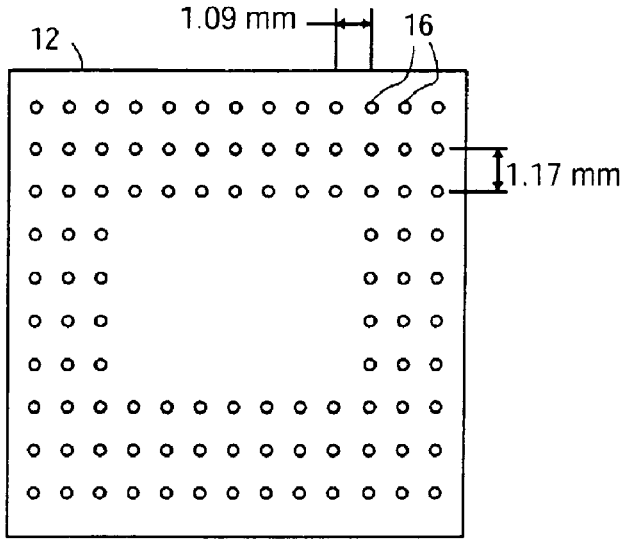
FIG. 3 is a top plan view on 3—3 in FIG. 2 illustrating a layout of the socket solder balls on a socket body of the electronic assembly.

As illustrated in FIG. 3, the socket body 12 has a generally square outline. As further illustrated in FIG. 3, the socket solder balls 16 form an array near four edges of the socket body 12, while a central region of the socket body 12 is free of socket solder balls 16. The 1.09 mm spacing between columns and 1.17 mm spacing between rows is maintained over the entire array of socket solder balls 16.

Figure 4:
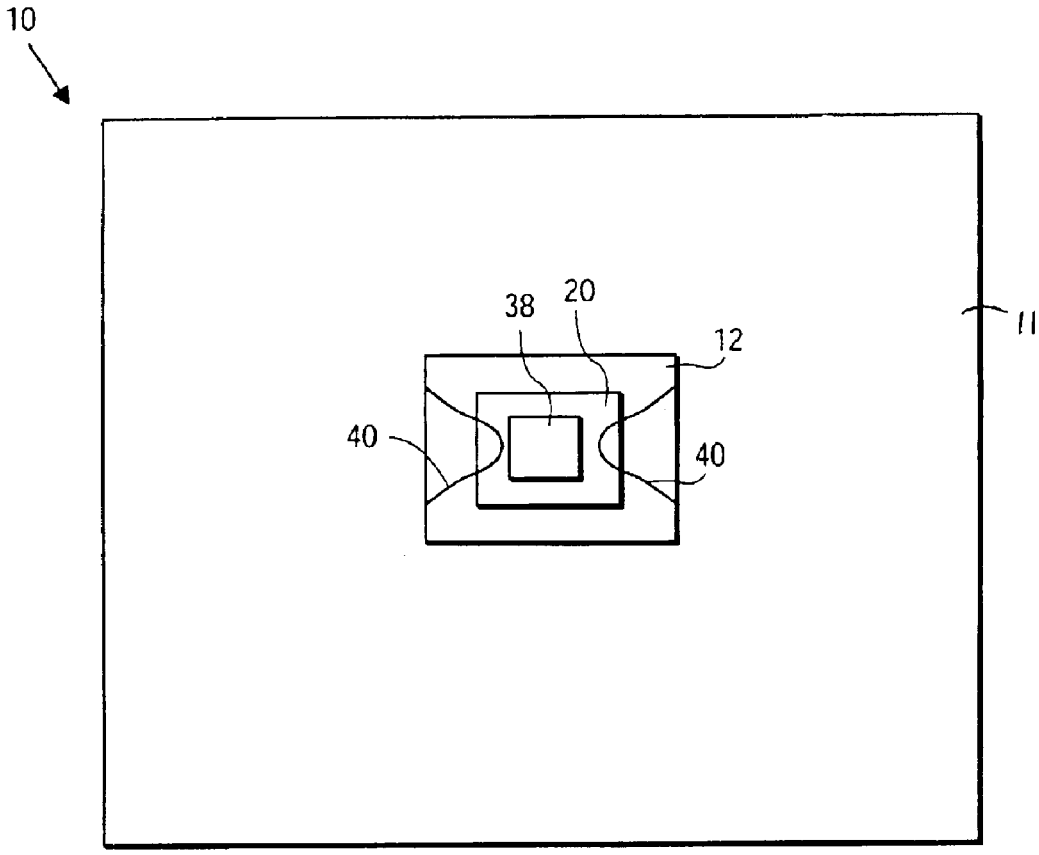
FIG. 4 is a top plan view of an outline of the entire electronic assembly.
Figure 5:
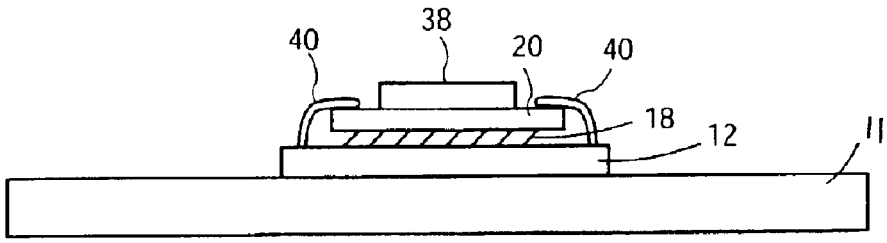
FIG. 5 is a side view of the electronic assembly illustrated in FIG. 4.

FIGS. 4 and 5 illustrate the electronic assembly in more detail. A microelectronic die, typically a semiconductor microelectronic die 38, is mounted on the package substrate 20. The package substrate 20 is then positioned on the free ends of the socket springs 18 and moved toward the socket body 12 to bend the cantilever portions 28 of the socket springs 18. A clamp 40 secured to the socket body 12 is positioned over the package substrate 20 to retain the package substrate 20 and the socket body 12 in position in a z-direction relative to one another, so as to maintain the bend shape of the socket springs 18.

An integrated circuit in the microelectronic die 38 is connected to contacts on the package substrate 20, and through vias in the package substrate 20 to the substrate contact terminals 22. Electric interconnections provided by the printed circuit board contact terminals 14, socket solder balls 16, socket springs 18, substrate contact terminals 22, and vias in the package substrate 20 allow for signals to be transmitted between traces on the board 11 and the integrated circuit in the microelectronic die 28.

In the exemplary embodiment, a first electronic device in the form of the socket body 12 is electrically connected to a second electronic device in the form of the package substrate 20. Another embodiment may make use of the principles of the invention to connect other electronic devices to one another.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed:

1. An electronic assembly, comprising:

first and second electronic devices;

first and second arrays of terminals in rows, extending in an x-direction, and columns, extending in a y-direction, on facing sides of the first and second electronic devices respectively, terminals of the second array being offset in the x- and y-directions relative to terminals of the first array; and a plurality of spring elements interconnecting corresponding terminals of the first and second arrays, each having a cantilever portion extending diagonally in the x- and y-directions between corresponding terminals of the first and second arrays.

2. The electronic assembly of claim 1, wherein the terminals have a larger pitch in the y-direction than in the x-direction.

3. The electronic assembly of claim 2, wherein each portion extends from a first terminal of the first array in a direction between second and third terminals of the first array, the first and second terminals being in the same column and adjacent rows, and the second and third terminals being in the same row and adjacent columns.

4. The electronic assembly of claim 3, wherein the portion extends at an angle which is less than 5° from an angle A relative to the y-direction, wherein:

$$A = \mathrm{TAN}^{-1}(\text{pitch in } x\text{-direction}/(\text{pitch in } y\text{-direction}\times 2)).$$

5. The electronic assembly of claim 1, further comprising:

a circuit board, the first electronic device being a socket body on the circuit board.

6. The electronic assembly of claim 5, wherein the spring contacts are secured to the terminals of the first array and bent by movement of the second electronic device toward the first electronic device.

7. The electronic assembly of claim 5, wherein the second electronic device is a semiconductor package comprising a package substrate, having the second array of terminals thereon, and a microelectronic die mounted to the package substrate.

8. The electronic assembly of claim 1, wherein each spring element has a spacer portion extending from a respective terminal of the first array away from the first electronic device, the cantilever portion of the respective spring element contact extending from the respective spacer portion.

9. The electronic assembly of claim 8, wherein the cantilever portion is bent by the second electronic device.

10. An electronic assembly, comprising:

a circuit board;

a socket body on the circuit board;

a first array of terminals on the socket body;

a package substrate;

a second array of terminals on a side of the package substrate facing the socket body, the terminals of the first and second arrays being located in rows, extending in an x-direction, and columns, extending in a y-direction, terminals of the second array being offset in the x- and y-directions relative to terminals of the first array;

a plurality of spring elements secured to the first array of terminals and interconnecting corresponding terminals of the first and second arrays, each having a cantilever portion extending diagonally in the x- and y-directions between corresponding terminals of the first and second arrays; and a microelectronic die mounted to the package substrate.

11. The electronic assembly of claim 10, wherein the terminals have a larger pitch in the y-direction than in the x-direction.

12. The electronic assembly of claim 11, wherein each cantilever portion extends from a first terminal of the first array in a direction between second and third terminals of the first array, the first and second terminals being in the same column and adjacent rows and the second and third terminals being in the same row and adjacent columns.

13. The electronic assembly of claim 12, wherein the cantilever portion extends at an angle which is less than 5° from an angle A relative to the y-direction, wherein:

$$A = \mathrm{TAN}^{-1}(\text{pitch in } x\text{-direction}/(\text{pitch in } y\text{-direction} \times 2)).$$

14. A socket, comprising:

a socket body;

an array of terminals on the socket body, in rows extending in an x-direction and columns extending in a y-direction; and a plurality of spring elements secured to respective ones of the terminals, each spring element having a cantilever portion extending diagonally in the x- and y-directions from the respective terminal to which the respective spring element is secured.

15. The socket of claim 14, wherein the terminals have a larger pitch in the y-direction than in the x-direction.

16. The socket of claim 15, wherein each portion extends from a terminal of the array in a direction between second and third terminals of the array, the second terminals being in the same column and adjacent rows and the second and third terminals being in the same row and adjacent columns.

17. The socket of claim 16, wherein the portion extends at an angle which is less than 5° from an angle A relative to the y-direction, wherein:

$$A = \mathrm{TAN}^{-1}(\text{pitch in } x\text{-direction}/(\text{pitch in } y\text{-direction} \times 2)).$$

* * * * *